US011081051B2

(12) United States Patent
Qian et al.

(10) Patent No.: US 11,081,051 B2
(45) Date of Patent: Aug. 3, 2021

(54) PIXEL COMPENSATION CIRCUIT

(71) Applicant: SeeYA Optronics Co., Ltd., Shanghai (CN)

(72) Inventors: Dong Qian, Shanghai (CN); Tong Wu, Shanghai (CN)

(73) Assignee: SeeYA Optronics Co., Ltd., Shanghai (CN)

( * ) Notice: Subject to any disclaimer, the term of this patent is extended or adjusted under 35 U.S.C. 154(b) by 0 days.

(21) Appl. No.: 17/023,965

(22) Filed: Sep. 17, 2020

(65) Prior Publication Data

US 2021/0174740 A1 Jun. 10, 2021

(30) Foreign Application Priority Data

Dec. 9, 2019 (CN) ..... 201911253409.3

(51) Int. Cl.
*G09G 3/3233* (2016.01)
*G09G 3/3291* (2016.01)

(52) U.S. Cl.
CPC ..... *G09G 3/3233* (2013.01); *G09G 3/3291* (2013.01); *G09G 2310/027* (2013.01); *G09G 2310/0291* (2013.01)

(58) Field of Classification Search
CPC ..... G09G 3/3233; G09G 3/3291; G09G 2310/027; G09G 2310/0291
See application file for complete search history.

(56) References Cited

U.S. PATENT DOCUMENTS 10,147,353 B2 12/2018 Xiang et al.
10,249,231 B2 * 4/2019 Cha ..... G09G 3/3208
10,720,088 B1 * 7/2020 Li ..... G09G 3/3208

FOREIGN PATENT DOCUMENTS

CN 106504706 3/2017

* cited by examiner

*Primary Examiner* — Stacy Khoo
(74) *Attorney, Agent, or Firm* — Forge IP, PLLC

(57) ABSTRACT

Provided is a pixel compensation circuit, which includes a signal amplification circuit, a signal storage circuit, a comparison calculation circuit and a signal compensation circuit. The signal amplification circuit collects an anode potential of an organic light emitting element and a driving current, such that the signal storage circuit can determine a threshold voltage of the driving transistor and a preset gray-scale voltage based on the anode potential and the driving current. The comparison calculation circuit calculates a compensation voltage required for the pixel while actually operating based on the threshold voltage, the anode potential and the preset gray-scale voltage. Thus, when a display gray-scale voltage is inputted, it can be compensated using the compensation voltage and then outputted to a gate of the driving transistor, such that the driving transistor can drive the organic light emitting element to emit light.

10 Claims, 7 Drawing Sheets

PIXEL COMPENSATION CIRCUIT

CROSS-REFERENCE TO RELATED APPLICATIONS

The present application claims the benefit of priority to Chinese Patent Application No. 201911253409.3, filed on Dec. 9, 2019, the content of which is incorporated herein by reference in its entirety.

TECHNICAL FIELD

The present disclosure relates to the field of electric circuit technologies, and particularly, to a pixel compensation circuit.

BACKGROUND

Organic Light Emitting Diode (OLED) display devices are characterized in that they are light and thin, self-luminous and rich in color, and have advantages such as high response speed, wide viewing angle, low power consumption, etc. Hence, OLED display devices have great potential to be applied widely.

Since OLED elements in an OLED display are current-driven elements, driving transistors are typically provided in the OLED display to drive the OLED elements. However, the threshold voltage, gate-source voltage, and source-drain voltage of the driving transistor may all drift due to the manufacture process and aging of the device, such that the driving circuit may change, resulting in uneven display. In the related art, before displaying a picture, OLED elements in a certain area are detected and all OLED elements of the display are compensated according to the detected data.

However, the compensation scheme in the related art only detects a certain area, and compensates all OLEDs after the detection. The compensation accuracy is low. In addition, as the current of the OLED is small, the detected current value may be absorbed by parasitic capacitance, such that the OLED cannot be compensated.

SUMMARY

The present disclosure provides a pixel compensation circuit, capable of improving the compensation accuracy.

A pixel compensation circuit is provided according to an embodiment of the present disclosure, for compensating a display gray-scale voltage for a pixel. The pixel includes an organic light emitting element and a driving transistor. The pixel compensation circuit includes:

a signal amplification circuit configured to collect an anode potential of the organic light emitting element and obtain a driving current flowing through the organic light emitting element based on the anode potential;

a signal storage circuit configured to store threshold voltages of the driving transistor, each corresponding to one anode potential of the organic light emitting element, and preset gray-scale voltages, each corresponding to one driving current flowing through the organic light emitting element, determine a threshold voltage of the driving transistor corresponding to the anode potential based on the anode potential, and determine a preset gray-scale voltage corresponding to the driving current based on the driving current;

a comparison calculation circuit configured to determine a current gray-scale voltage for the pixel based on a sum of the anode potential and the threshold voltage of the driving transistor corresponding to the anode potential, and determine a compensation voltage for the pixel based on a difference between the preset gray-scale voltage and the current gray-scale voltage; and a signal compensation circuit configured to receive a display gray-scale voltage for the pixel and the compensation voltage, and output a compensated gray-scale voltage for the pixel, as a sum of the display gray-scale voltage and the compensation voltage, to a gate of the driving transistor, so as to drive the organic light emitting element to emit light.

DESCRIPTION OF EMBODIMENTS

The present disclosure will be described in further detail below with reference to the drawings and embodiments. It can be understood that the specific embodiments described herein are only used to explain the present disclosure, rather than limiting the present disclosure. In addition, it should be noted that, in order to facilitate description, the drawings only show some, but not all, of structures related to the present disclosure.

The organic light emitting element is a current-driven element. When a pixel is provided with a gray-scale voltage, a driving transistor of the pixel will drive the organic light emitting element to emit light. At this time, a corresponding driving current flows through the organic light emitting element. The driving current flowing through the organic light emitting element depends on the gray-scale voltage, and the luminance of the light emitted from the organic light emitting element depends on a magnitude of the driving current. When a display panel is to display a picture, each pixel of the display panel is provided with a corresponding gray-scale voltage, such that each pixel of the display panel emits light, and the corresponding picture is displayed on the display panel. However, due to aging and other reasons, unevenness in display may occur to the display panel, so the gray-scale voltage for the pixel needs to be compensated.

Figure 1:
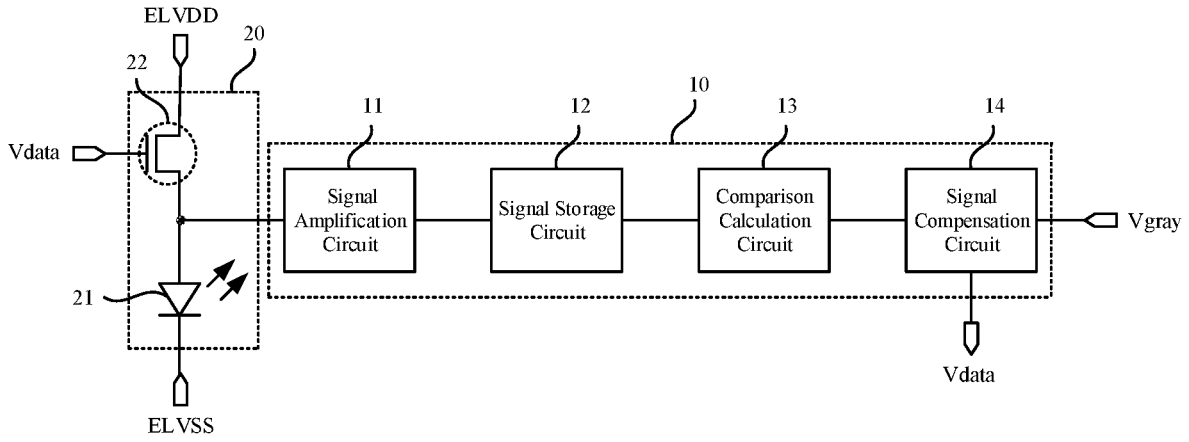
FIG. 1 is a block diagram showing a structure of a pixel compensation circuit according to an embodiment of the present disclosure.

Accordingly, embodiments of the present disclosure provide a pixel compensation circuit that can be used to compensate a gray-scale voltage for a pixel. The pixel includes an organic light emitting element and a driving transistor for driving the organic light emitting element to emit light. FIG. 1 is a block diagram showing a structure of a pixel compensation circuit according to an embodiment of the present disclosure. As shown in FIG. 1, the pixel compensation circuit 10 according to the embodiments of the present disclosure includes a signal amplification circuit 11, a signal storage circuit 12, a comparison calculation circuit 13 and a signal compensation circuit 14.

Here, the signal amplification circuit 11 is configured to collect an anode potential Vanode of the organic light emitting element 21 and obtain a driving current Ioled flowing through the organic light emitting element 21 based on the anode potential Vanode. The signal storage circuit 12 is configured to store threshold voltages of the driving transistor 22, each corresponding to one anode potential of the organic light emitting element 21, and preset gray-scale voltages, each corresponding to one driving current flowing through the organic light emitting element 21, determine a threshold voltage Vth for the driving transistor 22 corresponding to the anode potential Vanode based on the anode potential Vanode, and determine a preset gray-scale voltage Vdef corresponding to the driving current Ioled based on the driving current Ioled. The comparison calculation circuit 13 is configured to determine a current gray-scale voltage Vpre for the pixel 20 based on a sum of the anode potential Vanode and the threshold voltage Vth for the driving transistor 22 corresponding to the anode potential Vanode, and determine a compensation voltage Vcm for the pixel 20 based on a difference between the preset gray-scale voltage Vdef and the current gray-scale voltage Vpre. The signal compensation circuit 14 is configured to receive the display gray-scale voltage Vgray for the pixel and the compensation voltage Vcm, and output a compensated gray-scale voltage Vdata for the pixel 20, as a sum of the display gray-scale voltage Vgray and the compensation voltage Vcm, to a gate of the driving transistor 22, so as to drive the organic light emitting element 21 to emit light.

In particular, the signal storage circuit 12 stores threshold voltages of the driving transistor, each corresponding to one anode potential of the organic light emitting element 21. That is, the signal storage circuit 12 stores a plurality of different anode potentials of the organic light emitting element 21 and a plurality of different threshold voltages of the driving transistor 22, and each anode potential corresponds to one threshold voltage. For example, the anode potential Vanode1 corresponds to the threshold voltage Vth1, the anode potential Vanode2 corresponds to the threshold voltage Vth2, . . . , and the anode potential Vanoden corresponds to the threshold voltage Vthn, where n is a positive integer. Thus, before the pixel 20 emits light for displaying, the signal amplification circuit 11 collects the anode potential Vanode of the organic light emitting element 21 and outputs the collected anode potential Vanode to the signal storage circuit 12. The signal storage circuit 12 can determine the threshold voltage Vth corresponding to the anode potential Vanode based on the anode potential Vanode, and transmit the threshold voltage Vth to the comparison calculation circuit 13.

The signal storage circuit 12 also stores preset gray-scale voltages, each corresponding to one driving current flowing through the organic light emitting element 21. That is, the signal storage circuit 12 stores a plurality of different driving currents flowing through the organic light emitting element 21 and a plurality of different preset gray-scale voltages for the pixels 20, and each driving current corresponds to one preset gray-scale voltage. For example, the driving current Ioled1 corresponds to the preset gray-scale voltage Vdef1, the driving current Ioled2 corresponds to the preset gray-scale voltage Vdef12, . . . , and the driving current Ioledn corresponds to the preset gray-scale voltage Vdefn, where n is a positive integer. Thus, before the pixel 20 emits light for displaying, the signal amplification circuit 11 can obtain the driving current Ioled flowing through the organic light emitting element 21 based on the collected anode potential Vanode of the organic light emitting element 21, and output the driving current Ioled to the signal storage circuit. The signal storage circuit 12 can determine the preset gray-scale voltage Vdef corresponding to the driving current Ioled based on the driving current Ioled, and transmit the preset gray-scale voltage Vdef to the comparison calculation circuit 13.

Here, the determined preset gray-scale voltage Vdef is a theoretical gray-scale voltage corresponding to the driving current Ioled flowing through the organic light emitting element 21. However, due to e.g., drifting of the threshold voltage of the driving transistor 22 or attenuation of the organic light emitting element 21, the actual gray-scale voltage may be different from the preset gray-scale voltage Vdef. At this time, the comparison calculation circuit 13 can calculate the current gray-scale voltage Vpre based on the threshold voltage Vth of the driving transistor 22 and the anode potential Vanode of the organic light emitting element 21, and calculate a difference between the current gray-scale voltage Vpre and the preset gray-scale voltage Vdef to determine the corresponding compensation voltage Vcm. As such, when the display gray-scale voltage Vgray is inputted, the signal compensation circuit 14 can add the compensation voltage Vcm to the display gray-scale voltage Vgray to generate the compensated gray-scale voltage Vdata, and input the compensated gray-scale voltage Vdata to the gate of the driving transistor 22, such that the driving transistor 22 can generate a corresponding driving current in response to the compensated gray-scale voltage Vdata at its gate for driving the organic light emitting element 21 to emit light for displaying. In this way, the display panel is enabled to display a corresponding picture and the display effect of the display panel can be improved.

For example, as shown in FIG. 1, the pixel 20 includes the driving transistor 22 and the organic light emitting element 21. The gate of the driving transistor 22 receives the gray-scale voltage, the input terminal of the driving transistor 22 is electrically connected to the a power supply signal ELVDD, the output terminal of the driving transistor 22 is electrically connected to the anode of the organic light emitting element 21, and the cathode of the organic light emitting element 21 is electrically connected to a second power supply signal ELVSS. The first power supply signal ELVDD may be a high-level signal, and the second power supply signal ELVSS may be a low-level signal. At this time, the gray-scale voltage is the gate potential of the driving transistor 22, and the anode potential of the organic light emitting element 21 is the potential of the output terminal of the driving transistor 22. One of the input terminal and the output terminal of the driving transistor 22 is the source of the driving transistor 22, and the other is the drain of the driving transistor 22. For example, when the input terminal is the source of the driving transistor 22, the output terminal is the drain of the driving transistor 22. Since the threshold voltage of the driving transistor 22 changes with the gate voltage and source-drain voltage of the driving transistor 22, the driving transistor 22 has different threshold voltages given different gate voltages. In this way, when a gray-scale voltage is inputted to the gate of the driving transistor 22, the driving transistor 22 will be turned on, the anode potential of the organic light emitting element 21 is the drain potential of the driving transistor 22, and the threshold voltage Vth of the driving transistor 22 at this time can be equal to a difference between the gate potential of the driving transistor 22 and the anode potential Vanode of the organic light emitting element 21. That is, when the threshold voltage Vth corresponding to the anode potential Vanode of the organic light emitting element 21 is obtained, the current gray-scale voltage Vpre inputted to the gate of the driving transistor 22 can be calculated as a sum of the anode potential Vanode and the threshold voltage Vth corresponding to the anode potential Vanode. Then, the comparison calculation circuit 13 can calculate a difference between the current gray-scale voltage Vpre and the preset gray-scale voltage Vdef to determine the compensation voltage Vcm to be compensated for the pixel 20.

When the pixel compensation circuit 10 is applied to a display panel, the pixel compensation circuit 10 can collect the anode potential Vanode of the organic light emitting element 21 of the corresponding pixel 20 in the display panel before the display panel displays a picture normally, and generate the compensation voltage for the pixel 20. At the same time, one pixel compensation circuit 10 will only collect the anode potential of the organic light emitting element 21 of one pixel 20. In this way, it is possible to perform compensation for each pixel while considering the difference between the pixels 20.

According to the embodiment of the present disclosure, the signal amplification circuit collects the anode potential of the organic light emitting element and the driving current, such that the signal storage circuit can determine the threshold voltage of the driving transistor and the preset gray-scale voltage based on the anode potential and the driving current, respectively. The comparison calculation circuit can calculate the compensation voltage required for the actual operation of the pixel based on the threshold voltage, anode potential, and preset gray-scale voltage, such that when a display gray-scale voltage is inputted, the display gray-scale voltage can be compensated with the compensation voltage and outputted to the gate of the driving transistor which can drive the organic light emitting element to emit light. In this way, according to the current anode potential of the organic light emitting element and the driving current, the display gray-scale voltage for the pixel can be compensated, so as to improve the compensation accuracy for the pixel and enhance the display effect.

Figure 2:
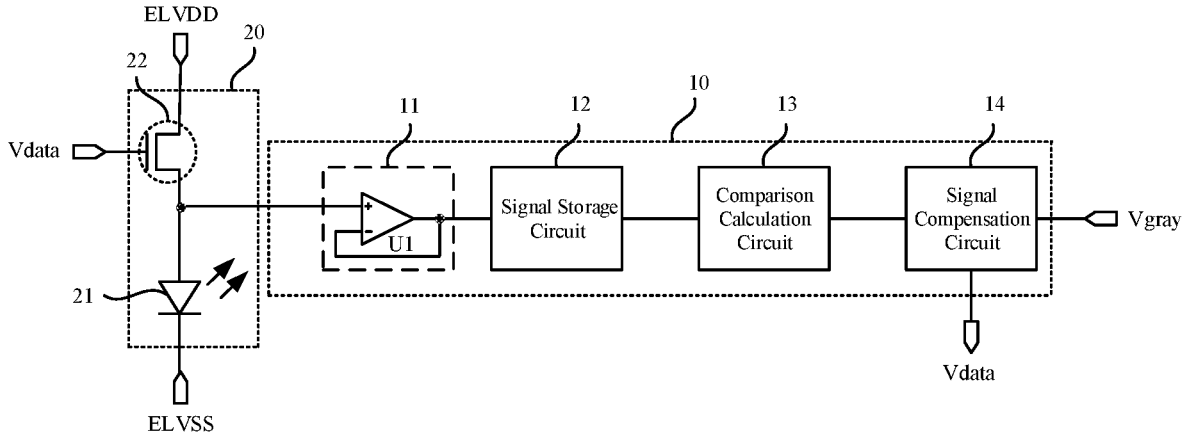
FIG. 2 is a schematic diagram showing a structure of a pixel compensation circuit according to an embodiment of the present disclosure.

As an example, FIG. 2 is a schematic diagram showing a structure of a pixel compensation circuit according to an embodiment of the present disclosure. As shown in FIG. 2, the signal amplification circuit 11 of the pixel compensation circuit 10 may include an operational amplifier U1 having an positive input terminal electrically connected to the anode of the organic light emitting element, an negative input terminal electrically connected to an output terminal of the operational amplifier U1, and the output terminal for outputting the anode potential and the driving current to the signal storage circuit 12.

In particular, the negative input terminal of the operational amplifier U1 is electrically connected to the output terminal of the operational amplifier U1, thereby forming a negative feedback structure. When the anode potential Vanode of the organic light emitting element 21 is inputted to the positive input terminal of the operational amplifier U1, the output terminal of the operational amplifier U1 outputs the anode potential Vanode of the organic light emitting element 21. While the output terminal of the operational amplifier U1 outputs the anode potential Vanode of the organic light emitting element 21, the driving current Ioled flowing through the organic light emitting element corresponding to the anode potential Vanode can be obtained, and the anode potential Vanode and the driving current Ioled are simultaneously inputted to the signal storage circuit 12, such that the signal storage circuit 12 can obtain the preset gray-scale voltage Vdef and the threshold voltage Vth of the driving transistor 22 based on the anode potential Vanode and the driving current Ioled. Thus, the comparison calculation circuit 13 can calculate the compensation voltage for the pixel 20 based on the anode potential Vanode, the preset gray-scale voltage Vdef and the threshold voltage Vth of the driving transistor 22, such that when a display gray-scale voltage is inputted, the signal compensation circuit 14 can perform signal compensation on the display gray-scale voltage. Here, for example, the operational amplifier U1 of the signal amplification circuit 11 may be a differential operational amplifier with high performance and high gain, such that the operational amplifier has high operating stability, thereby ensuring the accuracy of the collected anode potential Vanode and further improving the compensation accuracy.

Figure 3:
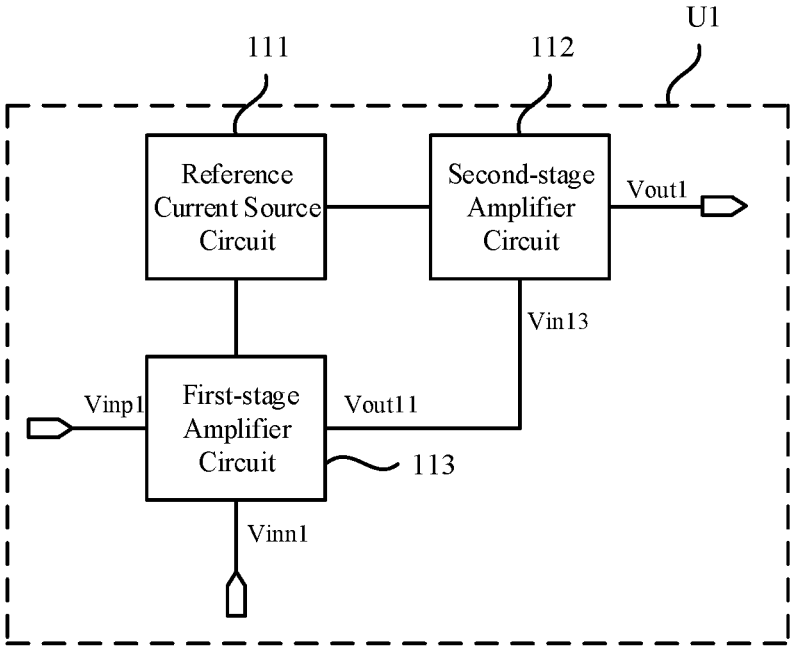
FIG. 3 is a schematic diagram showing a structure of an operational amplifier according to an embodiment of the present disclosure.

As an example, FIG. 3 is a schematic diagram showing a structure of an operational amplifier according to an embodiment of the present disclosure. As shown in FIG. 3, in a specific implementation, the operational amplifier U1 of the signal amplification circuit includes a reference current source circuit 111, a first-stage amplifier circuit 112, and a second-stage amplifier circuit 113. The reference current source circuit 111 provides a bias voltage for the first-stage amplifier circuit 112 and the second-stage amplifier circuit 113. A first input terminal Vinp1 of the first-stage amplifier circuit 112 is the positive input terminal of the operational amplifier U1, and the input terminal Vinn1 of the first-stage amplifier circuit 112 is the negative input terminal of the operational amplifier U1. The first-stage amplifier circuit 112 is a single-output differential amplifier circuit having a negative output terminal Vout11 which is the output terminal of the first-stage amplifier circuit 112. The output terminal Vout11 of the first-stage amplifier circuit 112 outputs a first-stage amplified signal. An input terminal Vin13 of the second-stage amplifier circuit 113 is electrically connected to the output terminal Vout11 of the first-stage amplifier circuit 112, and an output terminal Vout1 of the second-stage amplifier circuit 113 is the output terminal of the operational amplifier U1. The second-stage amplifier circuit 113 receives the first-stage amplified signal and outputs a second-stage amplified signal.

In particular, the reference current source circuit 111 provides a bias voltage to the first-stage amplifier circuit 112, such that when the anode potential Vanode of the organic light emitting element 21 is collected at the first input terminal Vinp1 of the first-stage amplifier circuit 112, the anode potential Vanode can be amplified at the first-stage and converted into a first-stage amplified signal, which is outputted to the input terminal Vin13 of the second-stage amplifier circuit 113 through the output terminal Vout11 of the first-stage amplifier circuit 112. The first-stage amplified signal is amplified by the second-stage amplifier circuit 113 and a second-stage amplified signal of the anode potential Vanode of the organic light emitting element 21 is outputted through the output terminal of the second-stage amplifier circuit 113. At the same time, in order to form the negative feedback structure of the operational amplifier U1, the first input terminal Vinp1 of the first-stage amplifier circuit 112 is also electrically connected to the output terminal Vout1 of the second-stage amplifier circuit 113. In this way, when the output terminal Vout1 of the second-stage amplifier circuit 113 outputs the second-stage amplified signal of the anode potential Vanode of the organic light emitting element 21, the driving current Ioled flowing through the organic light emitting element 21 can be obtained.

Figure 4:
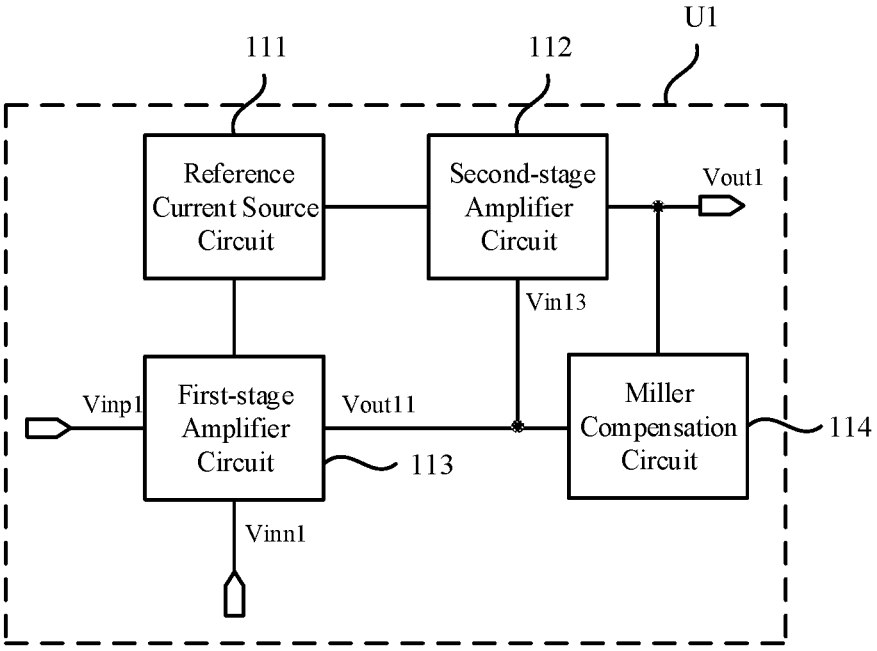
FIG. 4 is a schematic diagram showing a structure of another operational amplifier according to an embodiment of the present disclosure.

As an example, FIG. 4 is a schematic diagram showing a structure of yet another operational amplifier according to an embodiment of the present disclosure. As shown in FIG. 4, the operational amplifier U1 of the signal amplification circuit 11 further includes a Miller compensation circuit 114 connected between the input terminal Vin13 of the second-stage amplifier circuit 113 and the output terminal Vout1 of the second-stage amplifier circuit 113. The Miller compensation circuit 114 is configured to compensate a pole of the operational amplifier U1.

In particular, the operational amplifier U1 of the signal amplification circuit 11 has two poles, namely a primary pole and a secondary pole. Here, a larger distance between the primary pole and the secondary pole is more beneficial to the stable operation of the operational amplifier U1. The output terminal Vout1 of the second-stage amplifier circuit 113 in the operational amplifier U1 may be one pole of the operational amplifier U1. By connecting a Miller compensation circuit 114 between the input terminal Vin13 and the output terminal Vout1 of the second-stage amplifier circuit 113, the two poles of the operational amplifier U1 can be compensated to increase the distance between the two poles of the operational amplifier U1, so as to improve the stability of the operational amplifier, thereby improving the accuracy of the anode potential of the organic light emitting element 21 as collected by the signal amplification circuit 11, and further improving the pixel compensation accuracy.

Figure 5:
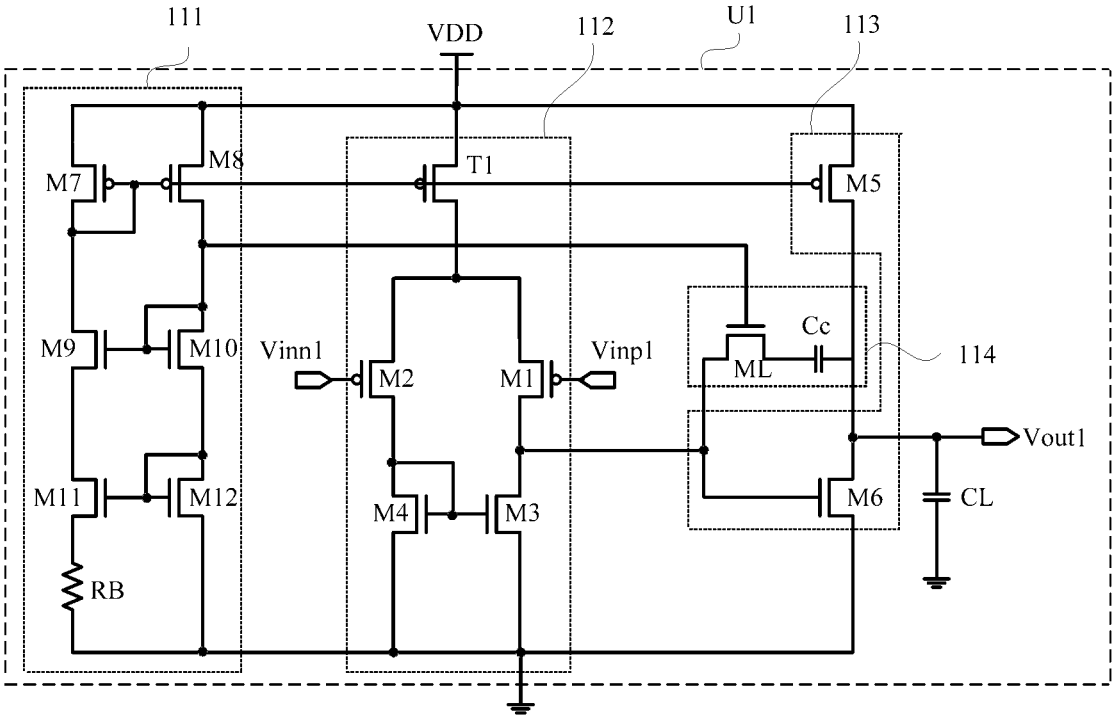
FIG. 5 is a schematic diagram showing a circuit structure of an operational amplifier according to an embodiment of the present disclosure.

As an example, FIG. 5 is a schematic diagram showing a circuit structure of an operational amplifier according to an embodiment of the present disclosure. As shown in FIG. 5, the Miller compensation circuit 114 of the operational amplifier U1 includes a compensation transistor ML and a compensation capacitor Cc. The control terminal of the compensation transistor ML receives the reference voltage provided by the reference current source circuit 111. An input terminal of the compensation transistor ML is electrically connected to the input terminal Vin13 of the second-stage amplifier circuit 113. An output terminal of the compensation transistor ML is electrically connected to the first terminal of the compensation capacitor Cc, and a second terminal of the compensation capacitor Cc is electrically connected to the output terminal Vout1 of the second-stage amplifier circuit 113. In this way, the Miller compensation circuit 114 can compensate the capacitance of the pole in the operational amplifier U1. Since the pole of the operational amplifier U1 is the reciprocal of the product of resistance and capacitance, when a capacitance of one pole in the operational amplifier U1 increases, a distance between the two poles of the operational amplifier U1 can be increased, thereby increasing the operation stability of the operational amplifier U1. The pole compensated by the Miller compensation circuit 114 may be the zero pole of the operational amplifier.

In a specific example, with reference to FIG. 5 again, the first-stage amplifier circuit 112 of the operational amplifier U1 may include a first tail current transistor T1, a first transistor M1, a second transistor M2, a third transistor M3, and a fourth transistor M4. Here, the first transistor M1 and the second transistor M2 are a pair of differential transistors. A control terminal of the first transistor M1 is the positive input terminal Vinp1 of the operational amplifier U1. A control terminal of the second transistor M2 is the negative input terminal Vinn1 of the operational amplifier U1. A control terminal of the first tail current transistor T1 receives the bias voltage provided by the reference current source circuit 113. An input terminal of the first tail current transistor T1 is electrically connected to the power supply VDD. An output terminal of the first tail current transistor T1 is electrically connected to the input terminals of the first transistor M1 and the second transistor M2, respectively. An input terminal of the third transistor M3 is a load of the first transistor M1. The third transistor M3 is electrically connected to the output terminal of the first transistor M1. The fourth transistor M4 is a load of the second transistor M2. An input terminal of the fourth transistor M4 is electrically connected to the output terminal of the second transistor M2. The input terminal and the control terminal of the fourth transistor M4 are both electrically connected to the control terminal of the third transistor M3. The output terminal of the third transistor M3 and the output terminal of the fourth transistor M4 are both grounded. The output terminal of the first transistor M1 is the output terminal of the first-stage amplifier circuit 112. In this way, when the anode potential of the organic light emitting element 21 is collected at the control terminal Vinp1 of the first transistor M1, the first-stage amplification of the anode potential of the organic light emitting element 21 can be achieved.

With reference to FIG. 5 again, the second-stage amplifier circuit 113 of the operational amplifier U1 includes a fifth transistor M5 and a sixth transistor M6. A control terminal of the fifth transistor M5 receives the bias voltage provided by the reference current source circuit 111. An input terminal of the fifth transistor M5 is electrically connected to the power supply VDD, and the output terminal of the fifth transistor M5 is electrically connected to the control terminal of the sixth transistor M6. The control terminal of the sixth transistor M6 is the input terminal Vin13 of the second-stage amplifier circuit 113, the output terminal of the sixth transistor M6 is grounded, and the input terminal of the sixth transistor M6 is the output terminal Vout1 of the operational amplifier U1. In this way, after the first-stage amplifier circuit 112 amplifies the anode potential of the organic light emitting element 21 at the first stage, the first-stage amplified signal can be inputted to the control terminal of the sixth transistor M6, such that the second-stage amplifier circuit 113 can amplify the anode potential of the organic light emitting element 21 at the second stage. The second-stage amplified signal can be outputted through the output terminal Vout1 of the operational amplifier U1.

In addition, the control terminal of the second transistor M2 in the first-stage amplifier circuit 112 is electrically connected to the input terminal of the sixth transistor M6 in the second-stage amplifier circuit 113 to form a negative feedback structure, such that the operational amplifier U1 has a negative feedback function. At the same time, the output terminal Vout1 of the operational amplifier U1 is also provided with a filter capacitor CL, which can filter and remove noise from the signal outputted from the output terminal Vout1 of the operational amplifier U1.

With reference to FIG. 5 again, the reference current source circuit 111 of the operational amplifier U1 may include a first mirror current source circuit, a second mirror current source circuit, a third mirror current source circuit, and a load resistor RB. The first mirror current source circuit includes a seventh transistor M7 and an eighth transistor M8. The control terminal and output terminal of the seventh transistor M7 are both electrically connected to the control terminal of the eighth transistor M8, and the input terminal of the seventh transistor M7 and the input terminal of the eighth transistor M8 are both electrically connected to the power supply VDD. The second mirror current source circuit includes a ninth transistor M9 and a tenth transistor M10. The control terminal and the input terminal of the tenth transistor M10 are both electrically connected to the control terminal of the ninth transistor M9. The input terminal of the ninth transistor M9 is electrically connected to the output terminal of the seventh transistor M7. The input terminal of the tenth transistor M10 is electrically connected to the output terminal of the eighth transistor M8. The third mirror current source circuit includes an eleventh transistor M11 and a twelfth transistor M12. The control terminal and the input terminal of the twelfth transistor M12 are both electrically connected to the control terminal of the eleventh transistor M11. The input terminal of the eleventh transistor M11 is electrically connected to the output terminal of the ninth transistor M9. The input terminal of the twelfth transistor M12 is electrically connected to the output terminal of the tenth transistor M10. The output terminal of the twelfth transistor M12 is grounded. The output terminal of the eleventh transistor M11 is grounded through the load resistor RB. The control terminal of the eighth transistor M8 is the output terminal of the reference current source circuit for outputting the bias voltage. In this way, the reference current source circuit 111 can generate the bias voltage and provide the bias voltage to the gate of the first tail current transistor T1 of the first-stage amplifier circuit 112 and the fifth transistor M5 of the second-stage amplifier circuit 113, respectively.

The operational amplifier U1 shown in FIG. 5 can have a gain up to 70 dB and a phase margin of 72°. It should be noted that the specific circuit structure of the operational amplifier U1 as described above is only an exemplary circuit structure. As long as the function of the signal amplification circuit can be achieved, the embodiment of the present disclosure is not limited to any specific circuit structure of the operational amplifier U1.

Figure 6:
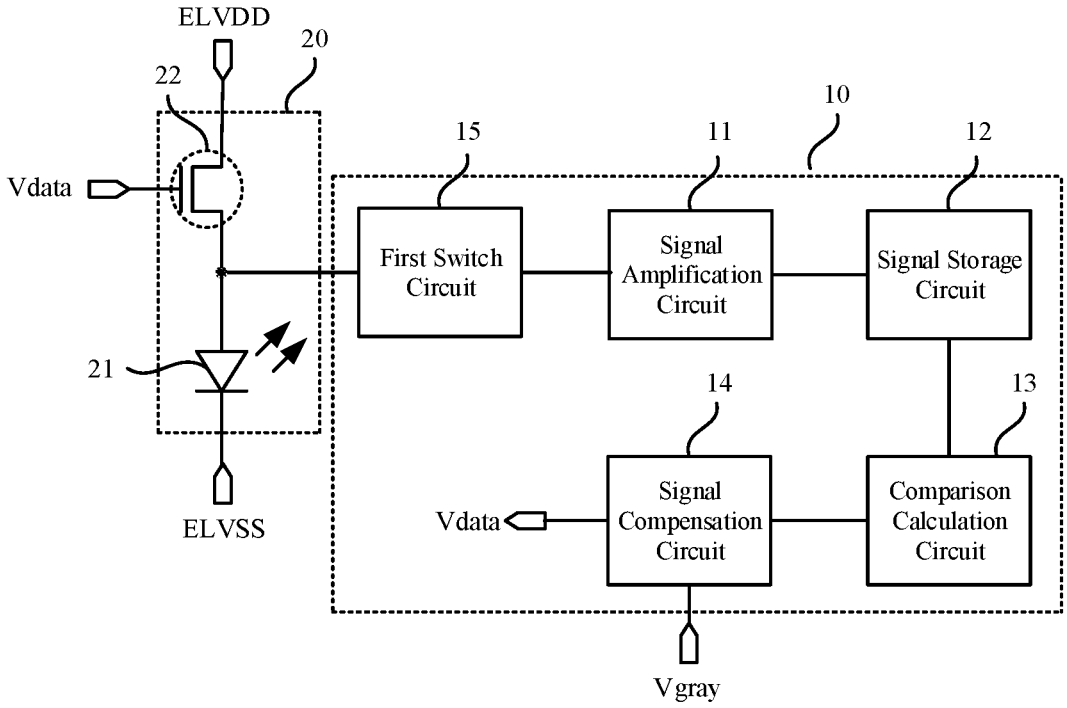
FIG. 6 is a block diagram showing a structure of another pixel compensation circuit according to an embodiment of the present disclosure.

As an example, FIG. 6 is a structural diagram showing a structure of another pixel compensation circuit according to an embodiment of the present disclosure. As shown in FIG. 6, the pixel compensation circuit 10 further includes a first switch circuit 15 which is electrically connected between the signal amplification circuit 11 and the anode of the organic light emitting element 21. The first switch circuit 15 is turned on in response to detecting a current outputted from the cathode of the organic light emitting element 21 is equal to a current inputted to the pixel, so as to enable the signal amplification circuit 11 to collect the anode potential of the organic light emitting element 21.

In particular, before the signal amplification circuit 11 collects the anode potential of the organic light emitting element 21, the driving transistor 22 will be turned on. At this time, a voltage, which may be any voltage that can turn on the driving transistor 22, will be written into the gate of the driving transistor 22. At the same time, the first power supply signal ELVDD passes through the driving transistor 22 to generate a corresponding current inputted to the organic light emitting element 21. At this time, an external detection circuit or a driving chip of the display panel can detect the current signal outputted from the cathode of the organic light emitting element 21. When the current signal outputted from the cathode of the organic light emitting element 21 is equal to the current generated by the first power supply signal ELVDD passing through the driving transistor 22, the first switch circuit 15 is turned on, such that the signal amplification circuit 11 can collect the anode potential of the organic light emitting element 21 through the turned-on first switch circuit 15 with a high stability, thereby further improving the compensation accuracy for the pixel 20. The first switch circuit 15 may be, for example, a transistor switch, and the embodiment of the present disclosure is not limited to this.

Figure 7:
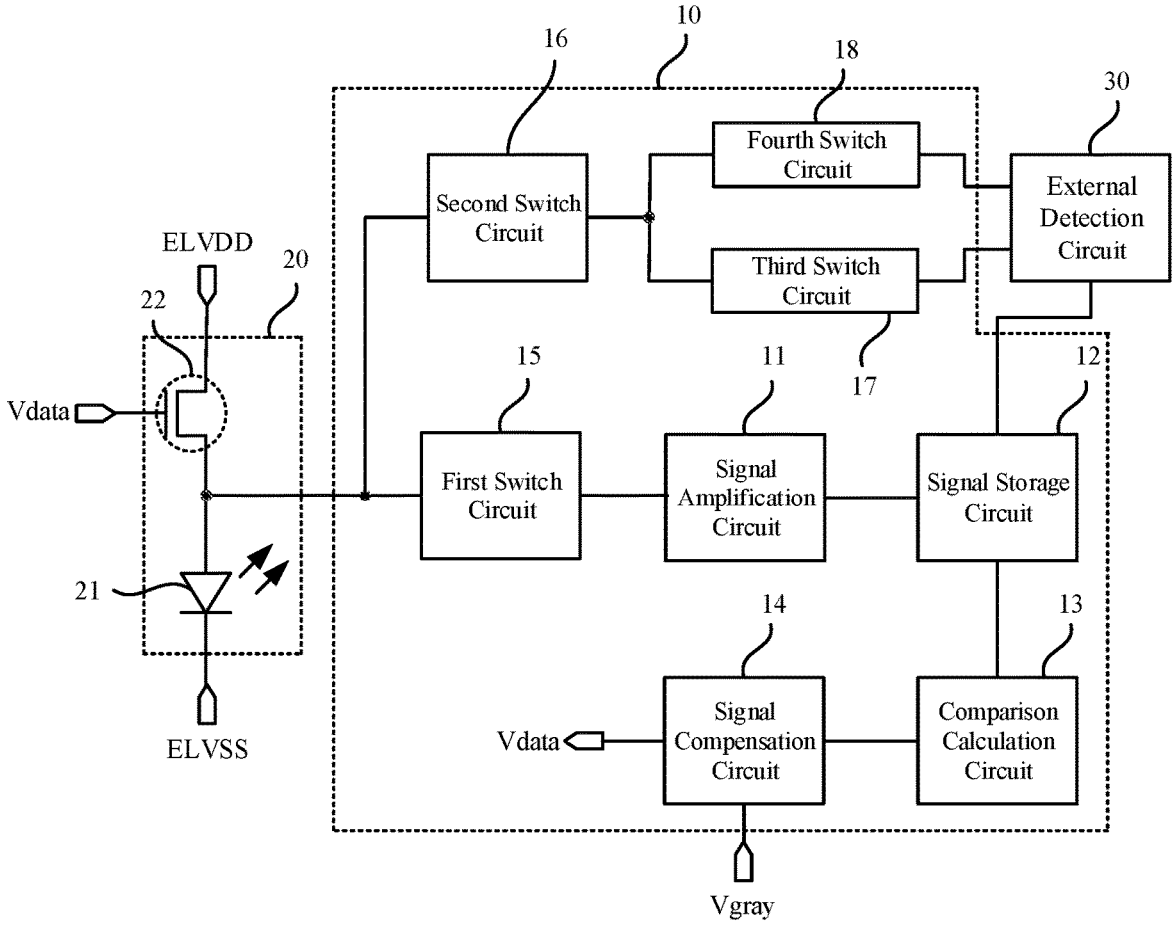
FIG. 7 is a block diagram showing a structure of yet another pixel compensation circuit provided by an embodiment of the present disclosure.

As an example, FIG. 7 is a structural diagram showing a structure of yet another pixel compensation circuit according to an embodiment of the present disclosure. As shown in FIG. 7, the pixel compensation circuit 10 further includes a second switch circuit 16, a third switch circuit 17 and a fourth switch circuit 18. The first terminal of the second switch circuit 16 is electrically connected to the anode of the organic light emitting element 21, and the second terminal of the second switch circuit 16 is electrically connected to the second terminal of the third switch circuit 17 and the first terminal of the fourth switch circuit 18, respectively. The first terminal of the third switch circuit 17 is electrically connected to a signal output terminal of an external detection circuit 30. The second terminal of the fourth switch circuit 18 is electrically connected to a signal detection terminal of the external detection circuit 30. When the second switch circuit 16 and the third switch circuit 17 are turned on and the fourth switch circuit 18 is turned off, the external detection circuit 30 provides an initial potential for the anode of the organic light emitting element 21 and a gray-scale voltage for the gate of the driving transistor 22. When the second switch circuit 16 and the fourth switch circuit 18 are turned on and the third switch circuit 17 is turned off, the external detection circuit 30 detects the anode potential of the organic light emitting element 21 to determine the threshold voltage of the driving transistor 22 based on the anode potential and the gray-scale voltage, generate a correspondence between the anode potential and the threshold voltage, and store it in the signal storage circuit 12.

In particular, the signal storage circuit 12 stores the correspondence between the anode potentials of the organic light emitting element 21 and the threshold voltages of the driving transistor 22, and the correspondence can be obtained by the external detection circuit 30. Before the display panel is assembled, the relationship between the anode potential of the organic light emitting element 21 of each pixel 20 in the display panel and the threshold voltage of the driving transistor 22 can be detected by the external detection circuit 30. That is, when the second switch circuit 16 and the third switch circuit 17 are turned on at the same time, the external detection circuit 30 writes an initial potential to the anode of the organic light emitting element 21, writes a gray-scale voltage to the gate of the driving transistor 22 at the same time, and obtains the current corresponding to the gray-scale voltage at the cathode of the organic light emitting element 21. When the external detection circuit 30 detects that the cathode current of the organic light emitting element 21 is in a stable state, the third switch circuit 17 is turned off and the second switch circuit 16 and the fourth switch circuit 18 are turned on. At this time, the external detection circuit 30 detects the anode potential of the organic light emitting element 21, and obtains the threshold voltage of the driving transistor 22 based on the difference between the gray-scale voltage and the anode potential. In this way, the external detection circuit 30 continuously changes the initial potential and the gray-scale voltage, detects a number of anode potentials, obtains the threshold voltage of the driving transistor 22 corresponding to each anode potential based on the difference between each gray-scale voltage and the anode potential, and stores the correspondence between the anode potentials and the threshold voltages in the signal storage circuit 12, such that when the pixel is to be compensated, the signal storage circuit 12 can find the corresponding threshold voltage based on the anode potential outputted from the signal amplification circuit 11.

The second switch circuit 16, the third switch 17, and the fourth switch 18 may all be transistor switches, and the embodiment of the present disclosure is not limited to this. Meanwhile, after the correspondence between the anode potentials and the threshold voltages has been obtained, the second switch 16 will be in an off state, and the signal amplification circuit 11 of the pixel compensation circuit 10 will collect the anode potential of the organic light emitting element 21 while the second switch 16 is in the off state.

Figure 8:
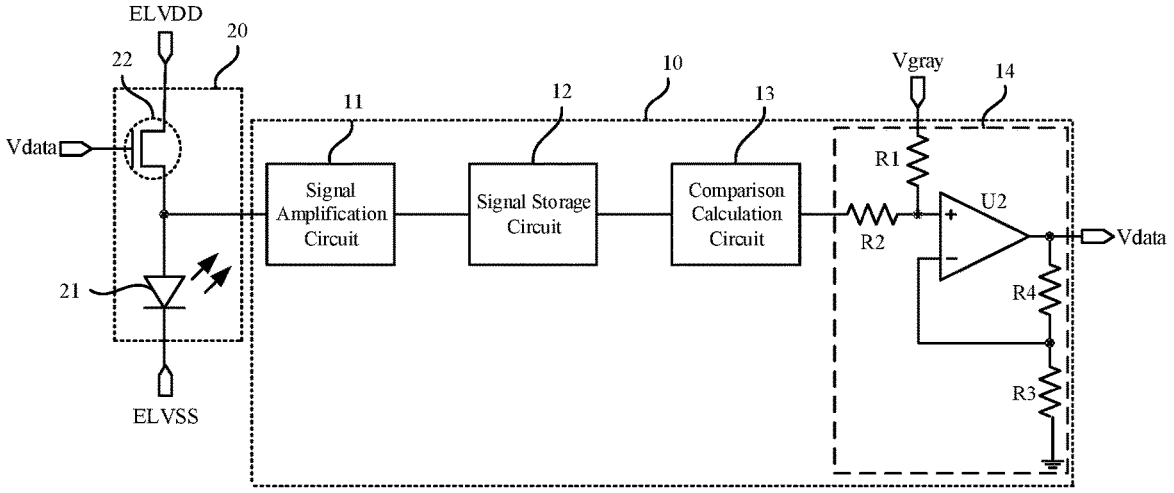
FIG. 8 is a schematic diagram showing a structure of still yet another pixel compensation circuit according to an embodiment of the present disclosure.

As an example, FIG. 8 is a schematic diagram showing a structure still yet another pixel compensation circuit according to an embodiment of the present disclosure. As shown in FIG. 8, the signal compensation circuit 14 of the pixel compensation circuit 10 may include a first resistor R1, a second resistor R2, a third resistor R3, a fourth resistor R4, and an adder U2. The first terminal of the first resistor R1 receives the gray-scale voltage Vgray, and the first terminal of the second resistor R2 receives the compensation voltage. The second terminal of the first resistor R1 and the second terminal of the second resistor R2 are both electrically connected to the positive input terminal of the adder U2. The negative input terminal of the adder U2 is electrically connected to the output terminal of the adder U2 through the fourth resistor R4. The negative input terminal of the adder U2 is also grounded through the third resistor R3. The output terminal of the adder U2 outputs the compensated gray-scale voltage Vdata.

In this way, the compensation voltage Vcm outputted from the comparison calculation circuit 13 is divided by the second resistor R2 and inputted to the positive input terminal of the adder U2. At the same time, the gray-scale voltage Vgray is divided by the second resistor R2 and also inputted to the positive input terminal of the adder U2. The negative input terminal of the adder U2 is grounded through the third resistor R3 and electrically connected to the output terminal Vout2 of the adder U2 through the fourth resistor R4, such that the adder U2 can sum up the compensation voltage Vcm inputted to its positive input terminal and the display gray-scale voltage Vgray to output the compensated gray-scale voltage Vdata for the pixel 20 to the gate of the driving transistor 22 of the pixel 20. Thus, the driving transistor 22 can drive the organic light emitting element 21 to emit light with the compensated gray-scale voltage Vdata.

The adder U2 can be a rail-to-rail operational amplifier. The input voltage of the rail-to-rail operational amplifier can be range from a positive voltage rail to a negative voltage rail, such that it can have a higher gain. The rail-to-rail operational amplifier can have a gain up to 82 dB and a phase margin of 75°.

Figure 9:
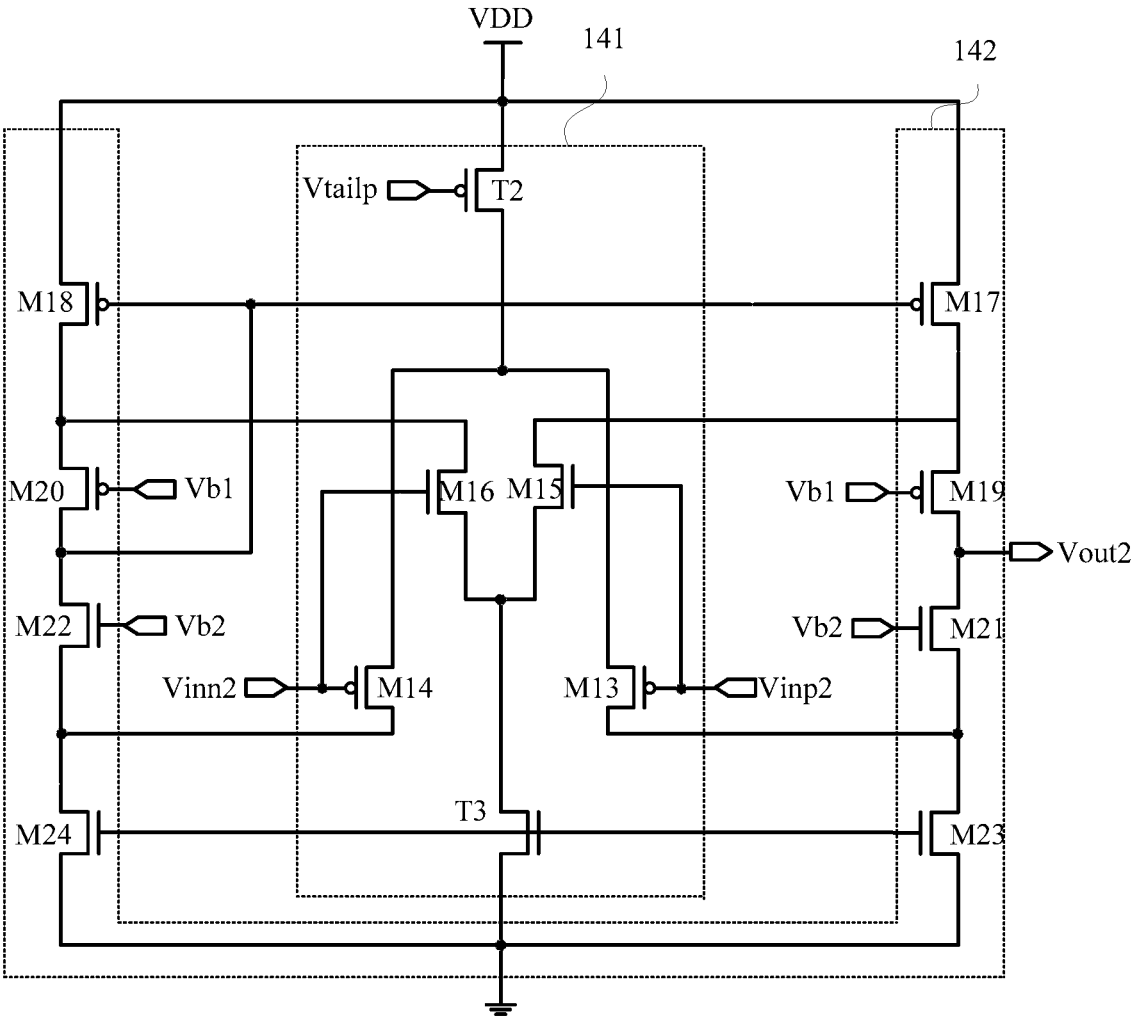
FIG. 9 is a schematic diagram showing a circuit structure of an adder according to an embodiment of the present disclosure.

As an example, FIG. 9 is a schematic diagram showing a circuit structure of an adder according to an embodiment of the present disclosure. As shown in FIG. 9, in a specific implementation, the adder U2 may include an input stage circuit 141 and an output stage circuit 142.

The input stage circuit 141 may include a thirteenth transistor M13, a fourteenth transistor M14, a fifteenth transistor M15, a sixteenth transistor M16, a second tail current transistor T2 and a third tail current transistor T3. Here, the thirteenth transistor M13 and the fourteenth transistor M14 are a pair of differential transistors. The control terminal of the thirteenth transistor M13 is the positive input terminal Vinp2 of the adder U2. The control terminal of the fourteenth transistor M14 is the inverted terminal Vinn2 of the adder U2. The input terminal of the thirteenth transistor M13 and the input terminal of the fourteenth transistor M14 are both electrically connected to the output terminal of the second tail current transistor T2. The control terminal of the second tail current transistor T2 is electrically connected to a tail current source Vtailp. The input terminal of the second tail current transistor T2 is electrically connected to the power supply VDD. The fifteenth transistor M15 and the sixteenth transistor M16 are a pair of differential transistors. The control terminal of the fifteenth transistor M15 is electrically connected to the control terminal of the thirteenth transistor M13. The control terminal of the sixteenth transistor M16 is electrically connected to the control terminal of the fourteenth transistor M14. The output terminal of the fifteenth transistor M15 and the output terminal of the sixteenth transistor M16 are both electrically connected to the input terminal of the third tail current transistor T3. The output terminal of the third tail current transistor T3 is grounded.

The output stage circuit 142 includes a seventeenth transistor M17, an eighteenth transistor M18, a nineteenth transistor M19, a twentieth transistor M20, a twenty-first transistor M21, a twenty-second transistor M22, a twenty-third transistor M23 and a twenty-fourth transistor M24. The control terminal of the seventeenth transistor M17 is electrically connected to the control terminal of the eighteenth transistor M18. The input terminal of the seventeenth transistor M17 and the input terminal of the eighteenth transistor M18 are both electrically connected to the power supply VDD. The output terminal of the transistor M17 is electrically connected to the input terminal of the fifteenth transistor M15. The output terminal of the eighteenth transistor M18 is electrically connected to the input terminal of the sixteenth transistor M16. The control terminal of the nineteenth transistor M19 and the control terminal of the twentieth transistor M20 are both electrically connected to a first bias source Vb1. The input terminal of the nineteenth transistor M19 is electrically connected to the output terminal of the seventeenth transistor M17. The input terminal of the twentieth transistor M20 is electrically connected to the output terminal of the eighteenth transistor M18. The output terminal of the twentieth transistor M20 is electrically connected to the control terminal of the eighteenth transistor M18. The output terminal of the nineteenth transistor M19 is the output terminal of the adder U2. The control terminal of the twenty-first transistor M21 and the control terminal of the twenty-second transistor M22 are both electrically connected to a second bias source Vb2. The input terminal of the twenty-first transistor M21 is electrically connected to the output terminal of the nineteenth transistor M19. The input terminal of the twenty-second transistor M22 is electrically connected to the output terminal of the twentieth transistor M20. The control terminal of the twenty-third transistor M23 and the control terminal of the twenty-fourth transistor M24 are both electrically connected to the control terminal of the third tail current transistor T3. The input terminal of the twenty-third transistor M23 is electrically connected to the output terminal of the twenty-first transistor M21 and the output terminal of the thirteenth transistor M13. The input terminal of the twenty-fourth transistor M24 is electrically connected to the output terminal of the twenty-second transistor M22 and the output terminal of the fourteenth transistor M14. The output terminal of the twenty-third transistor M23 and the output terminal of the twenty-fourth transistor M24 are both grounded.

In this way, the compensation voltage and the display gray-scale voltage can be inputted to the input stage circuit 141 through the positive input terminal Vinp2 of the adder U2, and the sum of the compensation voltage and the display gray-scale voltage can be outputted from the output stage circuit 142 of the adder U2, such that the output terminal Vout2 of the adder U2 outputs the compensated gray-scale voltage to the gate of the driving transistor 22 in the pixel 20.

Based on the same inventive concept, an embodiment of the present disclosure further provides a display panel including: m*n pixels and n pixel compensation circuits according to the embodiment of the present disclosure, the pixels in a same column sharing one pixel compensation circuit according to the embodiment of the present disclosure, where m and n are positive integers. Each pixel includes an organic light emitting element and a driving transistor. The driving transistor has a gate receiving the compensated gray-scale voltage provided by the pixel compensation circuit. The driving transistor has an input terminal receiving a first power supply signal. The organic light emitting element has a cathode receiving a second power supply signal. The driving transistor has an output terminal electrically connected to an anode of the organic light emitting element. The anode of the organic light emitting element is further electrically connected to the signal amplification circuit of the pixel compensation circuit. When the display panel according to the embodiment of the present disclosure includes the pixel compensation circuit according to the embodiment of the present disclosure, the display panel also has the technical effect of the pixel compensation circuit according to the embodiment of the present disclosure. Their common features will not be described in detail below, for which reference can be made to the above description of the pixel compensation circuit.

Figure 10:
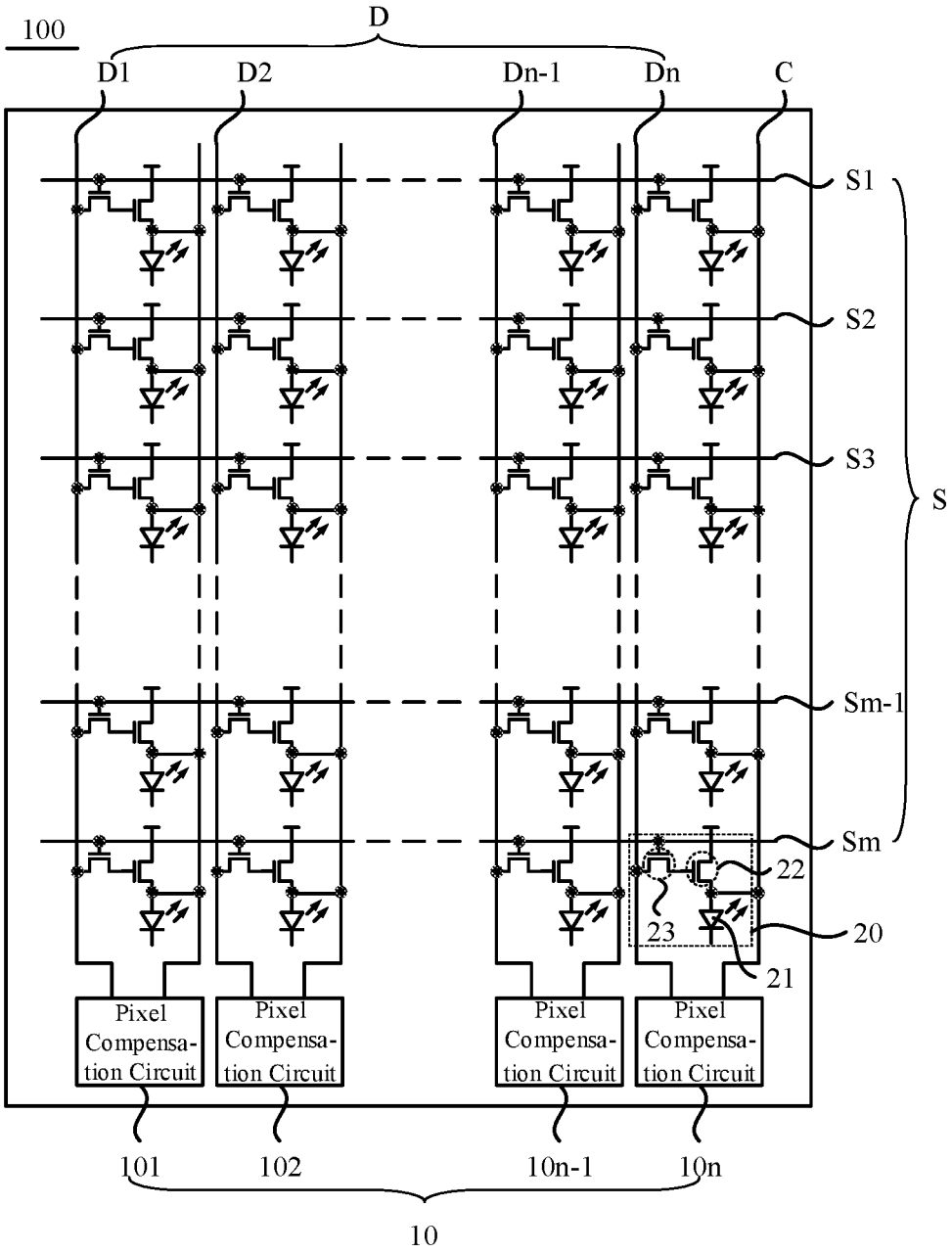
FIG. 10 is a schematic diagram showing a structure of a display panel according to an embodiment of the present disclosure.

In particular, FIG. 10 is a schematic diagram showing a structure of a display panel according to an embodiment of the present disclosure. A display panel 100 according to the embodiment of the present disclosure may be, for example, a silicon-based OLED display panel, and may be applied to electronic devices such as mobile phones, personal digital assistants, wearable devices, and displays. The embodiment of the present disclosure is not limited to this. When the display panel 100 is applied to an electronic device, the pixel compensation circuit 10 in the display panel 100 can collect the anode potential of each pixel 20 during the startup process of the electronic device, and generate a compensation voltage, such that when the electronic device is started to display, the display gray-scale voltage for each pixel 20 can be compensated with the generated compensation voltage.

For example, as shown in FIG. 10, the display panel 100 includes m*n pixels 20 arranged in an array, and each pixel 20 includes a driving transistor 22, a switching transistor 23, and an organic light emitting element 21. The display panel 100 further includes m scanning lines S, n data lines D, n detection lines C, and n pixel compensation circuits 10. The pixels in the same row share one scanning line S, and the pixels in the same column share one data line D and one detection line C. The pixel compensation circuit 10 obtains the anode potential of the organic light emitting element 21 in each pixel 20 through the detection line C, and inputs the generated compensated gray-scale voltage to each pixel 20 through the data line C. The gate of the switching transistor 23 of the pixel 20 is electrically connected to the scanning line S. The input terminal of the switching transistor 23 is electrically connected to the data line C. The output terminal of the switching transistor 23 is electrically connected to the gate of the driving transistor 22. The input terminal of the driving transistor 22 is electrically connected to a first power supply signal. The output terminal of the driving transistor 22 is electrically connected to the anode of the organic light emitting element 21. The cathode of the organic light emitting element 21 is electrically connected to a second power supply signal. During the startup process of the electronic device, the switching transistors 23 of the m*n pixels 20 in the display panel 100 are turned on row by row. For example, at a first time instant, the scanning signal transmitted on the scanning line S1 controls the switching transistors 23 of the first row of pixels 20 to turn on, and the scanning signals transmitted on the other scanning lines S control the switching transistors 23 of the other row of pixels 20 to turn off. The corresponding gray-scale voltage signal is input to each pixel 20 in the first row. At this time, the pixel compensation circuit 101, the pixel compensation circuit 102, . . . , the pixel compensation circuit 10*n*−1, and the pixel compensation circuit 10*n* collect the anode potentials of the organic light emitting element 21 in the pixels 20 in the first row through the detection lines C, respectively, and generate compensation voltages for the pixels 20 in the first row based on the collected anode potentials, respectively. When the display gray-scale signal of each pixel in the first row is inputted to the pixel compensation circuit 10, the pixel compensation circuit 10 can compensate the display gray-scale voltage for each pixel 20 in the first row with the compensation voltage for each pixel 20 to generate the compensated gray-scale voltage for each pixel 20, and transmit the compensated gray-scale voltage for each pixel 20 to each pixel 20 in the first row through one of the data line D1, data line D2, . . . , data line Dn−1 and data line Dn. The compensated gray-scale voltage for each pixel 20 is transferred from the switching transistor 23 of the pixel 20 to the gate of the driving transistor 22, such that the driving transistor 22 of each pixel 20 in the first row drives the organic light emitting element 21 to emit light for displaying. Correspondingly, the switching transistors 23 of the pixels 20 in the second row, the third row, . . . , the (m−1)-th row and the m-th row are controlled to be turned on and off by the scanning signals transmitted on their corresponding scanning lines S2, S3, . . . , Sm−1 and Sm are controlled. The compensation processes for the pixels 20 in the other rows are similar to the compensation process of the pixels 20 in the first row, and thus the description thereof will be omitted here.

In this way, each pixel of the display panel according to the embodiment of the present disclosure can use the pixel compensation circuit according to the embodiment of the present disclosure to compensate the display gray-scale voltage, and can compensate each pixel for the compensation voltage required by the pixel, instead of providing the same compensation for all pixels in an area. Further, each pixel can be compensated once before startup, thereby ensuring that the compensation voltage for each pixel is the voltage amount currently required by the pixel without affecting the display, such that the compensation accuracy of each pixel of the display panel can be further improved, the display unevenness of the display panel can be mitigated, and the display effect of the display panel can be enhanced.

Figure 11:
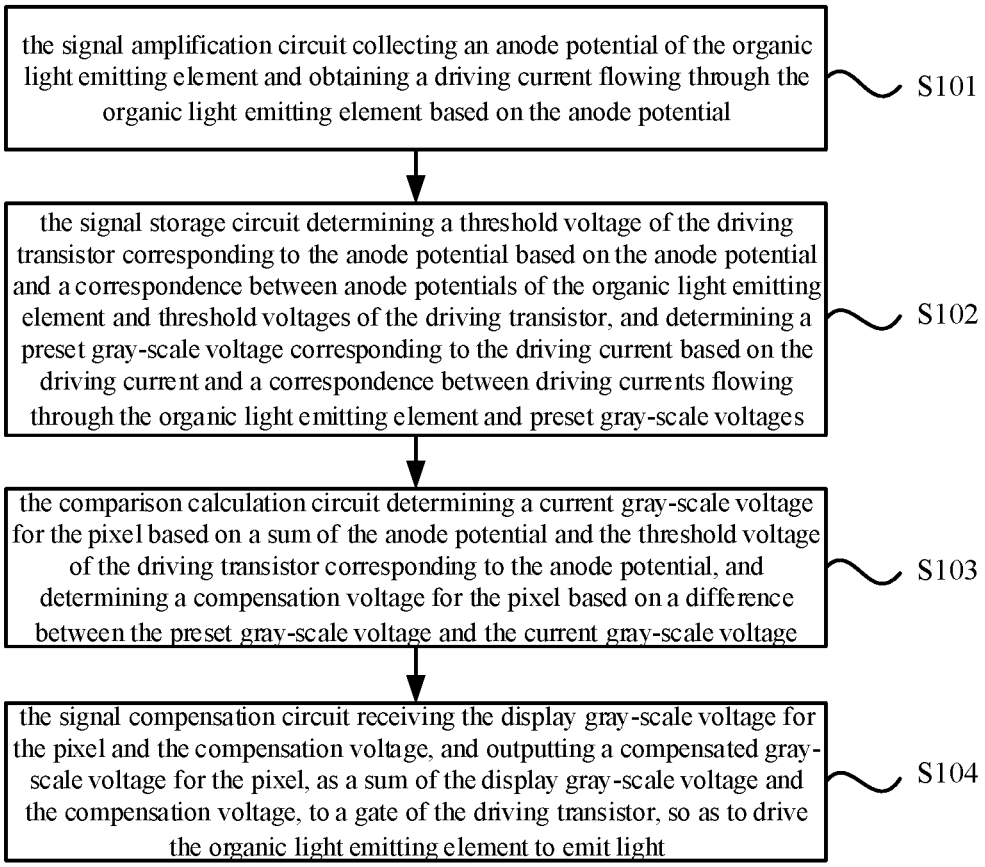
FIG. 11 is a flowchart of a pixel compensation method according to an embodiment of the present disclosure.

Based on the same inventive concept, an embodiment of the present disclosure also provides a pixel compensation method that uses the pixel compensation circuit according to the embodiment of the present disclosure to compensate the display gray-scale voltage for a pixel. The pixel includes an organic light emitting element and a driving transistor. The pixel compensation circuit includes a signal amplification circuit, a signal storage circuit, a comparison calculation circuit, and a signal compensation circuit. FIG. 11 is a flowchart of a pixel compensation method according to an embodiment of the present disclosure. With reference to FIGS. 2 and 11, the pixel compensation method includes the following steps.

At step S101, the signal amplification circuit collects the anode potential of the organic light emitting element, and obtains the driving current flowing through the organic light emitting element based on the anode potential.

Particularly, the signal amplification circuit 11 of the pixel compensation circuit 10 collects the anode potential of the organic light emitting element 21 in the pixel 20 and outputs the anode potential, and when the anode potential is outputted, the signal amplification circuit 11 can learn the driving current flowing through the organic light emitting element 21 corresponding to the anode potential, and output the driving current together with the collected anode potential.

At step S102, the signal storage circuit determines a threshold voltage of the driving transistor corresponding to the anode potential based on the anode potential and a correspondence between anode potentials of the organic light emitting element and threshold voltages of the driving transistor, and determines a preset gray-scale voltage corresponding to the driving current based on the driving current and a correspondence between driving currents flowing through the organic light emitting element and preset gray-scale voltages.

In particular, the signal storage circuit 12 of the pixel compensation circuit 10 stores the correspondence between the anode potentials of the organic light emitting element 21 and the threshold voltages of the driving transistor 22. The correspondence may be, for example, a one-to-one correspondence between the anode potentials of the organic light emitting element 21 and the threshold voltages of the driving transistor 22 as obtained by an external detection circuit providing an initial potential for the anode of the organic light emitting element 21 and writing a data voltage to the gate of the driving transistor 22, detecting the anode potential of the organic light emitting element 21, determining the threshold voltage of the driving transistor 22 based on a difference between the anode potential and the data voltage, and obtaining the correspondence based on the detected anode potential and the determined threshold voltage of the driving transistor 22. In this way, the signal storage circuit 12 can determine the threshold voltage of the driving transistor 22 corresponding to the anode potential outputted from the signal amplification circuit 11 based on the anode potential outputted from the signal amplification circuit 11 and the correspondence between the anode potentials of the organic light emitting element 21 and the threshold voltages of the driving transistor 22 as stored therein.

In addition, the signal storage circuit of the pixel compensation circuit 10 also stores the correspondence between the driving currents flowing through the organic light emitting element 21 and the preset gray-scale voltages. The correspondence may be, for example, a one-to-one correspondence between driving currents flowing through the organic light emitting element 21 and the preset gray-scale voltages as obtained by the external detection device providing a fixed potential for the anode of the organic light emitting element 21 and a preset gray-scale voltage for the cathode of the organic light emitting element 21 simultaneously, detecting the driving current flowing through the organic light emitting element 21, and obtaining the correspondence based on the provided preset gray-scale voltage and the detected driving current flowing through the organic light emitting element. In this way, the signal storage circuit 12 can determine the preset gray-scale voltage corresponding to the driving current outputted from the signal amplification circuit 11 based on the driving current outputted from the signal amplification circuit 11 and the correspondence between the driving currents flowing through the organic light emitting element 21 and the preset gray-scale voltages.

At step S103, the comparison calculation circuit determines a current gray-scale voltage for the pixel based on a sum of the anode potential and the threshold voltage of the driving transistor corresponding to the anode potential, and determines a compensation voltage for the pixel based on a difference between the preset gray-scale voltage and the current gray-scale voltage.

In particular, since the threshold voltage of the driving transistor 22 depends on the gray-scale voltage inputted to the driving transistor 22 and the source-drain voltage of the driving transistor, when different gray-scale voltages are inputted to the gate of the driving transistor 22, the driving transistor 22 will have different threshold voltages. The threshold voltage of the driving transistor 22 can be calculated based on the difference between the gray-scale voltage inputted to the gate of the driving transistor 22 and the anode potential of the organic light emitting element 21 electrically connected to the output terminal of the driving transistor 22. In this way, after the anode potential of the organic light emitting element 21 and the threshold voltage of the driving transistor 22 are obtained, the gray-scale voltage currently inputted to the driving transistor 22 can be calculated from the anode potential of the organic light emitting element 21 and the threshold voltage of the driving transistor 22. That is, the current gray-scale voltage can be calculated. Then, the voltage amount required to be compensated for the pixel 20, i.e., the compensation voltage for the pixel 20, can be calculated based on the difference between the current gray-scale voltage and the preset gray-scale voltage.

At step S104, the signal compensation circuit receives the display gray-scale voltage for the pixel and the compensation voltage, and output a compensated gray-scale voltage for the pixel, as a sum of the display gray-scale voltage and the compensation voltage, to a gate of the driving transistor, so as to drive the organic light emitting element to emit light.

In particular, before the display panel displays a picture, the anode potential of the organic light emitting element 21 of the pixel 20 in the display panel can be collected by the signal amplification circuit, and the compensation voltage for the pixel 20 can be obtained in a corresponding search and calculation process. When displaying a picture on the display panel, each pixel of the display panel is provided with a display gray-scale voltage. At this time, the signal compensation circuit 14 receives the display gray-scale voltage for the pixel 20 and the compensation voltage outputted from the comparison calculation circuit. The display gray-scale voltage and the compensation voltage are summed to obtain the compensated gray-scale voltage for the pixel 20, and the compensated gray-scale voltage is inputted to the gate of the driving transistor 22 of the pixel 20, such that the driving transistor 22 can drive the organic light emitting element 21 to emit light with the compensated gray-scale voltage, such that the display panel displays a corresponding picture. In this way, the display unevenness caused by the attenuation of the organic light emitting element 21 can be mitigated and the display effect of the display panel can be enhanced.

It should be noted that when the pixel compensation method according to the embodiment of the present disclosure uses the pixel compensation circuit according to the embodiment of the present disclosure to compensate the pixels, the pixel compensation method also has the technical effect of the pixel compensation circuit according to the embodiment of the present disclosure. Their common features will not be described in detail below, for which reference can be made to the above description of the pixel compensation circuit.

It is to be noted that what described above is only the preferred embodiments of the present disclosure and the technical principles they use. It can be appreciated by those skilled in the art that the present disclosure is not limited to the specific embodiments described herein, and it is possible for those skilled in the art to make various obvious changes, readjustments, combinations and substitutions without departing from the scope of protection of the present disclosure. Therefore, although the present disclosure has been described in more detail with reference to the above embodiments, the present disclosure is not limited to the above embodiments, and may include other equivalent embodiments without departing from the concept of the present disclosure. The scope of the present disclosure is determined by the claims as attached only.

What is claimed is:

1. A pixel compensation circuit for compensating a display gray-scale voltage for a pixel, the pixel comprising an organic light emitting element and a driving transistor, the pixel compensation circuit comprising:

a signal amplification circuit configured to collect an anode potential of the organic light emitting element and obtain a driving current flowing through the organic light emitting element based on the anode potential;

a signal storage circuit configured to store threshold voltages of the driving transistor, each corresponding to one anode potential of the organic light emitting element, and preset gray-scale voltages, each corresponding to one driving current flowing through the organic light emitting element, determine a threshold voltage of the driving transistor corresponding to the anode potential based on the anode potential, and determine a preset gray-scale voltage corresponding to the driving current based on the driving current;

a comparison calculation circuit configured to determine a current gray-scale voltage for the pixel based on a sum of the anode potential and the threshold voltage of the driving transistor corresponding to the anode potential, and determine a compensation voltage for the pixel based on a difference between the preset gray-scale voltage and the current gray-scale voltage; and a signal compensation circuit configured to receive the display gray-scale voltage for the pixel and the compensation voltage, and output a compensated gray-scale voltage for the pixel, as a sum of the display gray-scale voltage and the compensation voltage, to a gate of the driving transistor, so as to drive the organic light emitting element to emit light.

2. The pixel compensation circuit according to claim 1, wherein the signal amplification circuit comprises an operational amplifier having an positive input terminal electrically connected to an anode of the organic light emitting element, an negative input terminal electrically connected to an output terminal of the operational amplifier, and the output terminal for outputting the anode potential and the driving current to the signal storage circuit, wherein the operational amplifier comprises a reference current source circuit, a first-stage amplifier circuit, and a second-stage amplifier circuit, wherein the reference current source circuit is configured to provide a bias voltage for the first-stage amplifier circuit and the second-stage amplifier circuit, the first-stage amplifier circuit has a first input terminal which is the positive input terminal of the operational amplifier, and a second input terminal which is the negative input terminal of the operational amplifier, and the first-stage amplifier circuit is a single-output differential amplifier circuit having an inverted output terminal which is an output terminal of the first-stage amplifier circuit for outputting a first-stage amplified signal, and the second-stage amplifier circuit has an input terminal electrically connected to the output terminal of the first-stage amplifier circuit, and an output terminal which is an output terminal of the operational amplifier, and the second-stage amplifier circuit is configured to receive the first-stage amplified signal and output a second-stage amplified signal.

3. The pixel compensation circuit according to claim 2, wherein the first-stage amplifier circuit comprises: a first tail current transistor, a first transistor, a second transistor, a third transistor, and a fourth transistor, wherein the first transistor and the second transistor are a pair of differential transistors, the first transistor has a control terminal which is the positive input terminal of the operational amplifier, and the second transistor has a control terminal which is the negative input terminal of the operational amplifier, the first tail current transistor has a control terminal receiving the bias voltage provided by the reference current source circuit, an input terminal electrically connected to a power supply, and an output terminal electrically connected to the input terminal of the first transistor and the input terminal of the second transistor, respectively, the third transistor has an input terminal which is a load of the first transistor, and the third transistor is electrically connected to an output terminal of the first transistor; the fourth transistor is a load of the second transistor, and the fourth transistor has an input terminal electrically connected to an output terminal of the second transistor and an input terminal and a control terminal both electrically connected to a control terminal of the third transistor; and an output terminal of the third transistor and an output terminal of the fourth transistor are both grounded, and wherein the output terminal of the first transistor is the output terminal of the first-stage amplifier circuit.

4. The pixel compensation circuit according to claim 2, wherein the second-stage amplifier circuit comprises a fifth transistor and a sixth transistor, wherein the fifth transistor has a control terminal receiving the bias voltage provided by the reference current source circuit, an input terminal electrically connected to a power supply, and an output terminal electrically connected to a control terminal of the sixth transistor, and the control terminal of the sixth transistor is the input terminal of the second-stage amplifier circuit, and the sixth transistor has an output terminal which is grounded and an input terminal which is the output terminal of the operational amplifier.

5. The pixel compensation circuit according to claim 2, wherein the reference current source circuit comprises a first mirror current source circuit, a second mirror current source circuit, a third mirror current source circuit, and a load resistor, wherein the first mirror current source circuit comprises a seventh transistor and an eighth transistor, the seventh transistor has a control terminal and an output terminal both electrically connected to a control terminal of the eighth transistor, and an input terminal of the seventh transistor and an input terminal of the eighth transistor are both electrically connected to a power supply, the second mirror current source circuit comprises a ninth transistor and a tenth transistor, the tenth transistor has a control terminal and an input terminal both electrically connected to a control terminal of the ninth transistor, the ninth transistor has an input terminal electrically connected to the output terminal of the seventh transistor, and the tenth transistor has an input terminal electrically connected to an output terminal of the eighth transistor, the third mirror current source circuit comprises an eleventh transistor and a twelfth transistor, the twelfth transistor has a control terminal and an input terminal both electrically connected to a control terminal of the eleventh transistor, the eleventh transistor has an input terminal electrically connected to an output terminal of the ninth transistor, the twelfth transistor has an input terminal electrically connected to the output terminal of the tenth transistor, the output terminal of the twelfth transistor is grounded, and the eleventh transistor has an output terminal grounded through the load resistor, and the control terminal of the eighth transistor is the output terminal of the reference current source circuit, and is configured to output the bias voltage.

6. The pixel compensation circuit according to claim 2, wherein the operational amplifier further comprises a Miller compensation circuit which is connected between the input terminal of the second-stage amplifier circuit and the output terminal of the second-stage amplifier circuit and is configured to compensate a pole of the operational amplifier, wherein the Miller compensation circuit comprises a compensation transistor and a compensation capacitor, wherein the compensation transistor has a control terminal receiving the reference voltage provided by the reference current source circuit, an input terminal electrically connected to the input terminal of the second-stage amplifier circuit, and an output terminal electrically connected to a first terminal of the compensation capacitor, and the compensation capacitor has a second terminal electrically connected to the output terminal of the second-stage amplifier circuit.

7. The pixel compensation circuit according to claim 1, further comprising: a first switch circuit electrically connected between the signal amplification circuit and the anode of the organic light emitting element, the first switch circuit being turned on in response to detecting that a current outputted from a cathode of the organic light emitting element is equal to a current inputted to the pixel, so as to enable the signal amplification circuit to collect the anode potential of the organic light emitting element.

8. The pixel compensation circuit according to claim 1, further comprising: a second switch circuit, a third switch circuit, and a fourth switch circuit, wherein the second switch circuit has a first terminal electrically connected to the anode of the organic light emitting element, and a second terminal electrically connected to a second terminal of the third switch circuit and a first terminal of the fourth switch circuit, respectively; the third switch circuit has a first terminal electrically connected to a signal output terminal of an external detection circuit; and the fourth switch circuit has a second terminal electrically connected to a signal detection terminal of the external detection circuit, and wherein, when the second switch circuit and the third switch circuit are turned on and the fourth switch circuit is turned off, the external detection circuit provides an initial potential for the anode of the organic light emitting element and provides a gray-scale voltage for the gate of the driving transistor; when the second switch circuit and the fourth switch circuit are turned on and the third switch circuit is turned off, the external detection circuit detects the anode potential of the organic light emitting element to determine the threshold voltage of the driving transistor based on the anode potential and the gray-scale voltage, generates a correspondence between the anode potential and the threshold voltage and stores the correspondence in the signal storage circuit.

9. The pixel compensation circuit according to claim 1, wherein the signal compensation circuit comprises a first resistor, a second resistor, a third resistor, a fourth resistor, and an adder, wherein the first resistor has a first terminal receiving the display gray-scale voltage, the second resistor has a first terminal receiving the compensation voltage, and a second terminal of the first resistor and a second terminal of the second resistor are both electrically connected to an positive input terminal of the adder, and the adder has an negative input terminal electrically connected to an output terminal of the adder through the fourth resistor, and the negative input terminal of the adder is also grounded through the third resistor, the adder has an output terminal for outputting the compensated gray-scale voltage.

10. The pixel compensation circuit according to claim 9, wherein the adder comprises an input stage circuit and an output stage circuit, wherein the input stage circuit comprises a thirteenth transistor, a fourteenth transistor, a fifteenth transistor, a sixteenth transistor, a second tail current transistor, and a third tail current transistor, wherein the thirteenth transistor and the fourteenth transistor are a pair of differential transistors, the thirteenth transistor has a control terminal which is the positive input terminal of the adder, the fourteenth transistor has a control terminal which is the negative input terminal of the adder, an input terminal of the thirteenth transistor and an input terminal of the fourteenth transistor are both electrically connected to an output terminal of the second tail current transistor, and the second tail current transistor has a control terminal electrically connected to a tail current source and an input terminal electrically connected to a power supply, the fifteenth transistor and the sixteenth transistor are a pair of differential transistors, the fifteenth transistor has a control terminal electrically connected to the control terminal of the thirteenth transistor, the sixteenth transistor has a control terminal electrically connected to the control terminal of the fourteenth transistor, an output terminal of the fifteenth transistor and an output terminal of the sixteenth transistor are both electrically connected to an input terminal of the third tail current transistor, and the third tail current transistor has an output terminal which is grounded, and the output stage circuit comprises a seventeenth transistor, an eighteenth transistor, a nineteenth transistor, a twentieth transistor, a twenty-first transistor, a twenty-second transistor, a twenty-third transistor, and a twenty-fourth transistor, wherein the seventeenth transistor has a control terminal electrically connected to a control terminal of the eighteenth transistor, an input terminal of the seventeenth transistor and an input terminal of the eighteenth transistor are both electrically connected to the power supply, the seventeenth transistor has an output terminal electrically connected to an input terminal of the fifteenth transistor, and the eighteenth transistor has an output terminal electrically connected to an input terminal of the sixteenth transistor, a control terminal of the nineteenth transistor and a control terminal of the twentieth transistor are both electrically connected to a first bias voltage source, the nineteenth transistor has an input terminal electrically connected to the output terminal of the seventeenth transistor, the twentieth transistor has an input terminal electrically connected to the output terminal of the eighteenth transistor and an output terminal of the twentieth transistor electrically connected to the control terminal of the eighteenth transistor, the nineteenth transistor has an output terminal which is the output terminal of the adder, a control terminal of the twenty-first transistor and a control terminal of the twenty-second transistor are both electrically connected to a second bias voltage source, the twenty-first transistor has an input terminal electrically connected to the output terminal of the nineteenth transistor, and the twenty-second transistor has an input terminal electrically connected to the output terminal of the twentieth transistor, and a control terminal of the twenty-third transistor and a control terminal of the twenty-fourth transistor are both electrically connected to a control terminal of the third tail current transistor, the twenty-third transistor has an input terminal electrically connected to an output terminal of the twenty-first transistor and the output terminal of the thirteenth transistor, the twenty-fourth transistor has an output terminal electrically connected to an output terminal of the twenty-second transistor and the output terminal of the fourteenth transistor, and an output terminal of the twenty-third transistor and an output terminal of the twenty-fourth transistor are both grounded.

* * * * *